US006375005B1

(12) United States Patent
McCann

(10) Patent No.: US 6,375,005 B1
(45) Date of Patent: Apr. 23, 2002

(54) PACKAGING AND DISPLAYING DEVICE FOR A SPANNER

(75) Inventor: Francis E. McCann, Taichung Hsien (TW)

(73) Assignee: Stanley Chiro International Ltd., Taichung Hsien (TW)

( * ) Notice: Subject to any disclaimer, the term of this patent is extended or adjusted under 35 U.S.C. 154(b) by 13 days.

(21) Appl. No.: 09/667,645

(22) Filed: Sep. 22, 2000

(51) Int. Cl.[7] ..... B65D 75/56

(52) U.S. Cl. ..... 206/349; 206/376; 206/477; 248/309.1; 211/70.6

(58) Field of Search ..... 206/349, 376, 206/377, 477, 495; 211/70.6; 248/309.1

(56) References Cited

U.S. PATENT DOCUMENTS

| | | | | | |
|---|---|---|---|---|---|
| 5,335,772 | A | * | 8/1994 | Chervenak et al. | 206/349 |
| 5,803,253 | A | * | 9/1998 | Zakarian | 206/349 |
| RE37,129 | E | * | 4/2001 | Chow | 206/349 |
| 6,241,208 | B1 | * | 6/2001 | Lin | 248/309.1 |
| 6,315,119 | B1 | * | 11/2001 | Lee | 206/349 |

* cited by examiner

*Primary Examiner*—David T. Fidei
(74) *Attorney, Agent, or Firm*—Akin, Gump, Strauss, Hauer & Feld, L.L.P.

(57) ABSTRACT

A packaging and displaying device includes a backing mount member, an annular wheel member uni-directionally rotatable relative to the backing mount member, an anchoring member having a spindle portion which passes through and which rotates with the wheel member to engage a clamped member. The clamped member has a clamped portion adapted to be clamped by a clamping head of a spanner when a movable jaw portion of the spanner is biased to turn towards a stationary jaw portion. A spanner holding member has an anchored end portion with an anchored hole to be sleeved on and to be rotated with the clamped member, and a stabilizing end portion provided with a securing member for hindering a handle of the spanner from moving away therefrom, thereby preventing theft. A key and keyway arrangement is disposed between the stabilizing end portion and the backing mount member to stabilize swinging movement of the spanner holding member relative to the backing mount member when the clamped member rotates with the annular wheel member. Therefore, the clamped portion of the clamped member can be turned via the spanner so as to enable customers to study and operate the spanner.

4 Claims, 6 Drawing Sheets

PACKAGING AND DISPLAYING DEVICE FOR A SPANNER

BACKGROUND OF THE INVENTION

1. Field of the Invention

This invention relates to a spanner, more particularly to a packaging and displaying device for a spanner.

2. Description of the Related Art

Referring to FIG. 1, a conventional spanner 1 is shown to include a handle 11 with proximate and distal ends opposite to each other in a longitudinal direction. A clamping head is disposed on the proximate end of the handle 11, and has a stationary jaw portion 14 and a movable jaw portion 12 which is biased by a biasing member 13 to turn towards the stationary jaw portion 14 about a pivot axis that is transverse to the longitudinal direction. The biasing member 13 and a pulling rod 15 are received in a sliding groove 111 which is formed in the handle 11 between the proximate and distal ends and which extends in the longitudinal direction. The pulling rod 15 is pulled along the sliding groove 111 to turn the movable jaw portion 12 away from the stationary jaw portion 14 against the biasing force of the biasing member 13 so as to permit a screw fastener (not shown) to extend into a clamping space between the jaw portions 14, 12. The screw fastener can be clamped tightly by the jaw portions 14, 12 after the pulling rod 15 is released, thereby permitting turning of the screw fastener via the spanner which is rotated in one of clockwise and counterclockwise directions. When the spanner is rotated in the other of clockwise and counterclockwise directions, the movable jaw portion 12 can be moved away from the stationary jaw portion 14 so as to disengage the screw fastener, thereby not turning the latter.

However, the conventional spanner is packaged in a closed paper box for selling, and cannot be studied and operated practically by a customer. Therefore, it is difficult for a customer to have a better understanding of the spanner.

SUMMARY OF THE INVENTION

The object of the present invention is to provide a packaging and displaying device which can cooperate with a spanner and which facilitates study and operation of the spanner by a customer.

According to this invention, the packaging and displaying device includes a backing mount member, a work piece member, a spanner holding member, a securing member, and a key and keyway arrangement. The backing mount member has front and rear walls opposite to each other in a transverse direction. The front wall includes a mounting portion which has an annular bearing wall to define a through hole with a rotating axis for communicating with the rear wall, and a guiding portion opposite to the mounting portion in a longitudinal direction. The work piece member includes an annular wheel member, an anchoring member, and a clamped member. The annular wheel member has a rim portion rotatable relative to the annular bearing wall, and a hub portion surrounding the rotating axis. A ratchet toothed member is disposed between the rim portion and the annular bearing wall to permit unidirectional rotation of the annular wheel member relative to the annular bearing wall. The anchoring member has an enlarged head portion which is disposed rearwardly of and which is in frictional contact with the rear wall of the backing mount member, and a spindle portion which has a proximate end disposed normal to the enlarged head portion and insertable into and rotatable with the hub portion, and a distal end extending from the proximate end in the transverse direction to extend forwardly of the front wall of the backing mount member. The clamped member includes a socket end which engages the distal end of the spindle portion of the anchoring member by press fitting in the transverse direction, an annular mount portion which is disposed outwardly of the socket end to surround the rotating axis, and a clamped portion which is disposed opposite to the annular mount portion in the transverse direction, and which is adapted to be clamped by a clamping head of a spanner when a movable jaw portion of the spanner is biased to turn towards a stationary jaw portion. The spanner holding member includes forward and rearward walls opposite to each other in the transverse direction, and has an anchored end portion which defines an anchored hole that extends through the forward and rearward walls so as to be sleeved on and to be rotated with the annular mount portion of the clamped member about the rotating axis, and a stabilizing end portion opposite to the anchored end portion in the longitudinal direction. The securing member is disposed on the forward wall at the stabilizing end portion, and is adapted to hinder the distal end of the handle of the spanner from moving away from the forward wall in the transverse direction. The key and keyway arrangement is disposed between the rearward wall at the stabilizing end portion of the spanner holding member and the front wall at the guiding portion of the backing mount member so as stabilize swinging movement of the spanner holding member relative to the backing mount member when the clamped member rotates with the annular wheel member. As such, the clamped portion of the clamped member can be turned via the spanner so as to enable customers to study and operate the spanner.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
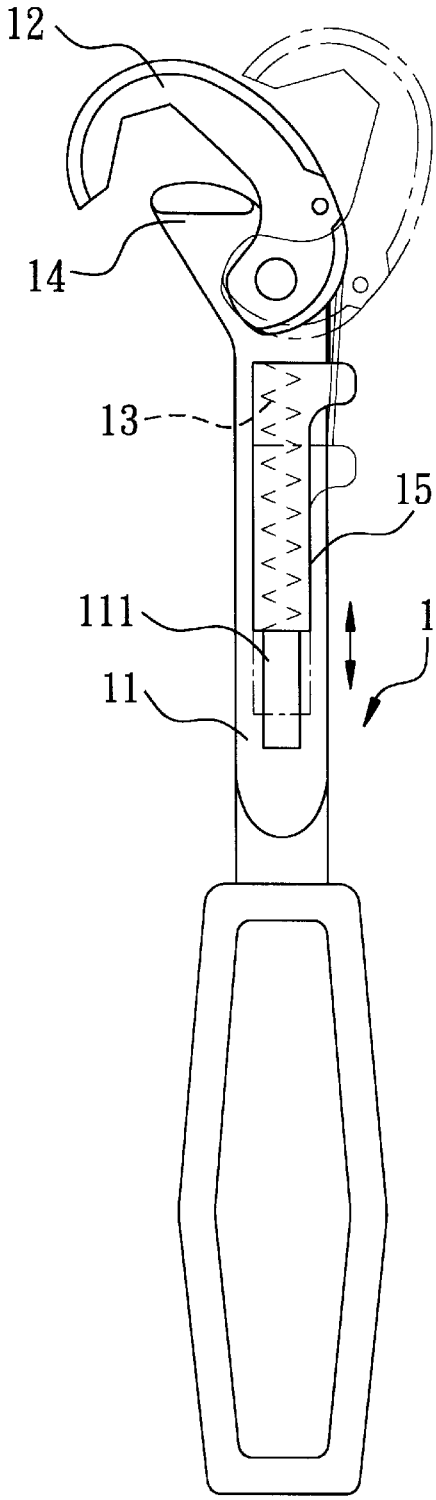
FIG. 1 PRIOR ART
FIG. 1 is a schematic view of a conventional spanner.
Figure 2:
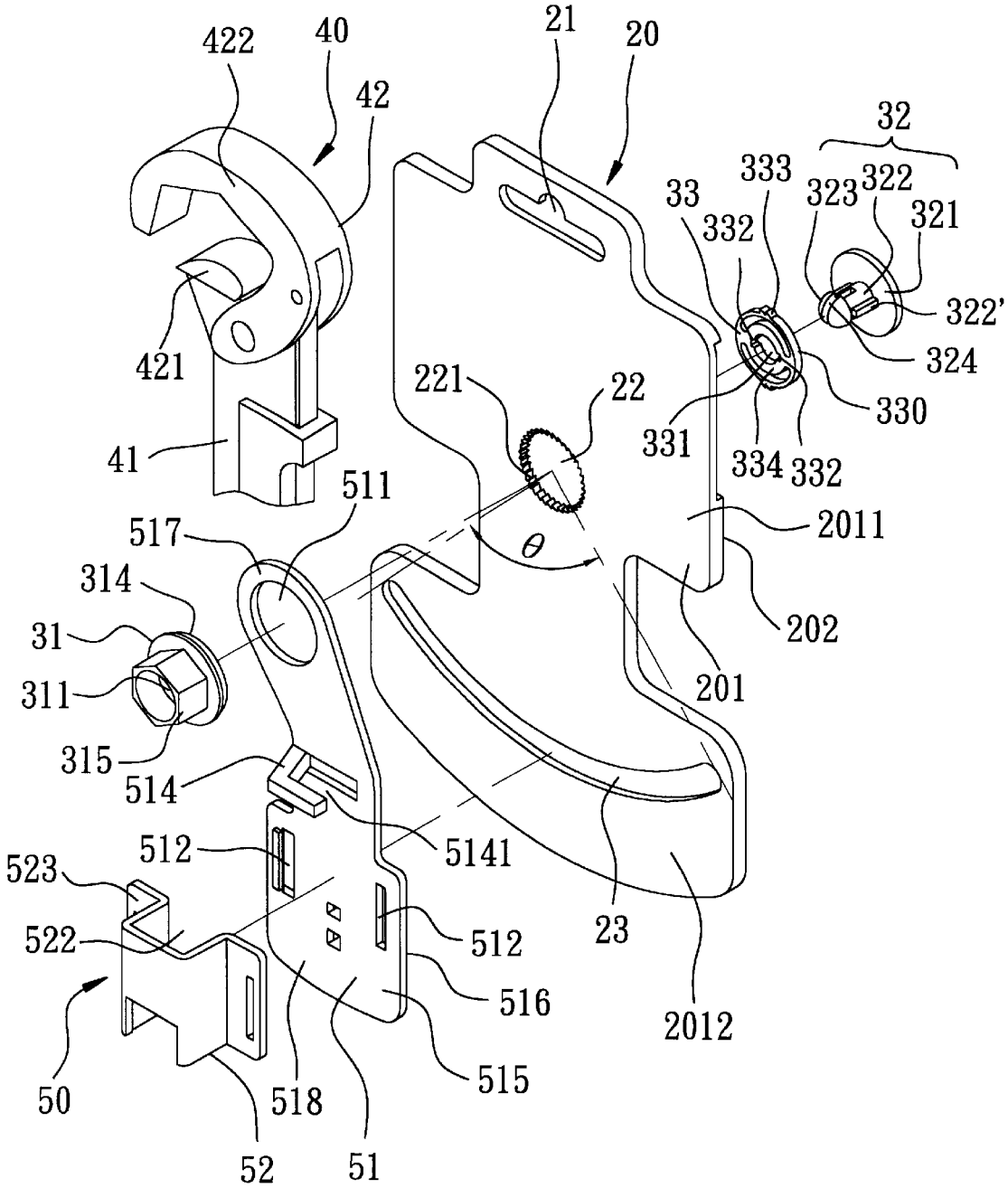
FIG. 2 is an exploded perspective view of a preferred embodiment of a packaging and displaying device according to this invention.
Figure 3:
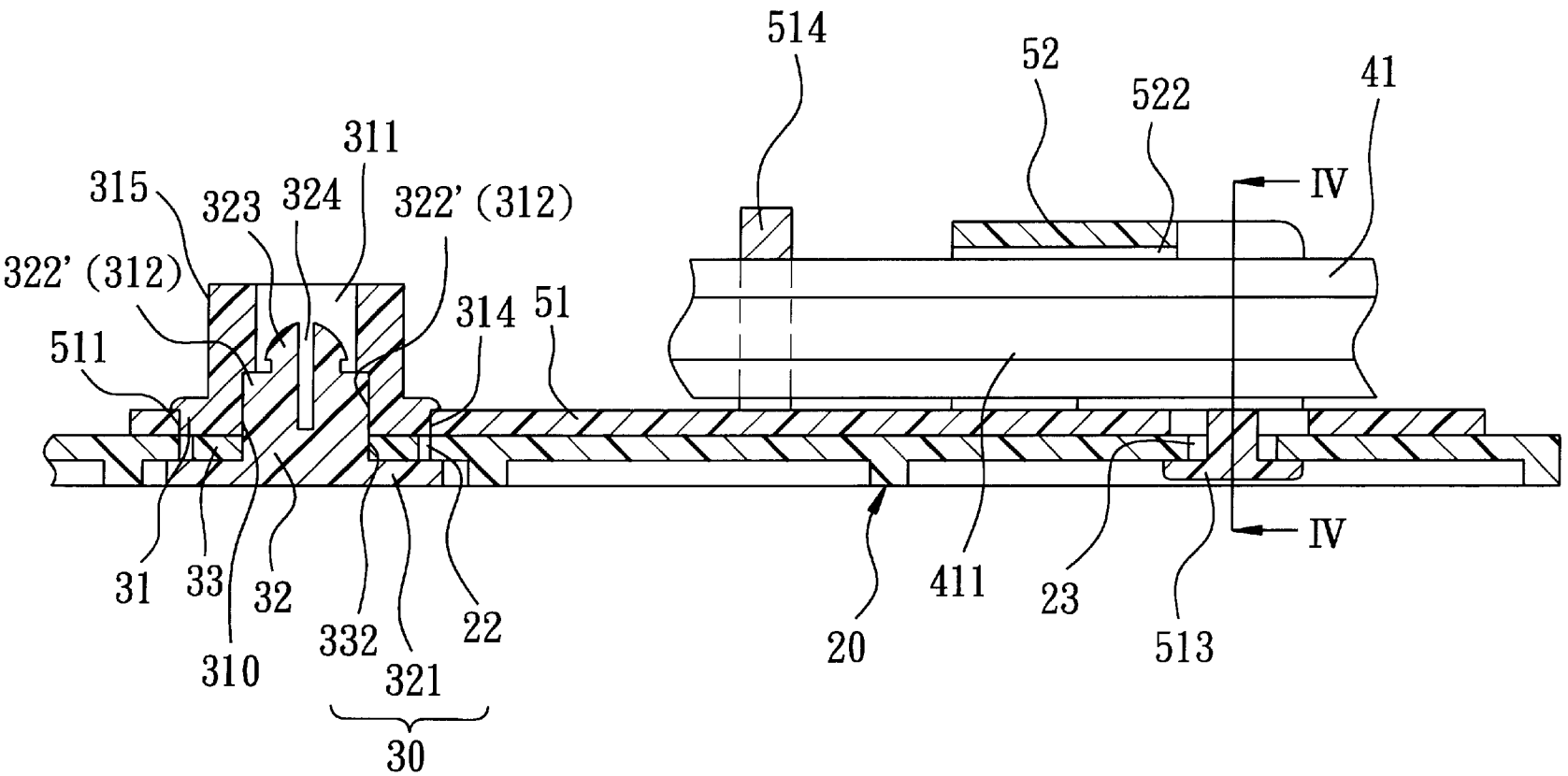
FIG. 3 is a sectional view of a portion of the preferred embodiment.

Referring to FIGS. 2 and 3, the preferred embodiment of the packaging and displaying device according to the present invention is shown to comprise a backing mount member 20, a work piece member 30, a spanner holding member 51, and a securing member 50.

The backing mount member 20 has front and rear walls 201,202 opposite to each other in a transverse direction. The front wall 201 includes a mounting portion 2011 and a guiding portion 2012 opposite to the mounting portion 2011 in a longitudinal direction. The mounting portion 2011 has a hanging hole 21 which extends to communicate with the rear wall 202, and an annular bearing wall 221 to define a through hole 22 with a rotating axis for communicating with the rear wall 202. The annular bearing wall 221 is formed with an annular ratchet toothed member. An arcuate sliding groove 23 is formed in the guiding portion 2012, and extends about the rotating axis of the through hole 22. The sliding groove 23 has two ends which cooperate with the rotating axis to confine an angle θ which is at least 60°.

The work piece member 30 includes an annular wheel member 33, an anchoring member 32, and a clamped member 31.

The annular wheel member 33 has a rim portion 330 which is disposed to be rotatable relative to the annular bearing wall 221 and which is provided with a ratchet toothed member 333 so as to engage threadedly the ratchet toothed member of the annular bearing wall 221 to permit uni-directional rotation of the annular wheel member 33 relative to the annular bearing wall 221, and a hub portion 334 which is disposed to surround the rotating axis and which has a sleeve hole 331 and two engaging slots 332 diametrically disposed opposite to each other.

The anchoring member 32 is made of a plastic material, and has an enlarged head portion 321 which is disposed rearwardly of and which is in frictional contact with the rear wall 202 of the backing mount member 20, and a spindle portion 322. The spindle portion 322 has a proximate end which is disposed normal to the enlarged head portion 321 and which is insertable into a sleeve hole 331 in the hub portion 334 by means of two engaging blocks 322' that engage the engaging slots 332 so as to be rotatable with the annular wheel member 33, and a distal end 323 which extends from the proximate end in the transverse direction to extend forwardly of the front wall 201 of the backing mount member 20, and which is formed with a slit 324.

The clamped member 31 has a through hole 311 which extends therethrough in the transverse direction, and includes a socket end 310 which is formed with two elongate slots 312 that engage the engaging blocks 322' of the spindle portion 322 of the anchoring member 32 by press fitting in the transverse direction via the slit 324, an annular mount portion 314 which is disposed outwardly of the socket end 310 to surround the rotating axis, and a clamped portion 315 which is disposed opposite to the annular mount portion 314 in the transverse direction, and which is adapted to be clamped by a clamping head 42 of a spanner 40 to coincide the rotating axis with a pivot axis of the spanner 40 when a movable jaw portion 422 of the latter is biased to turn towards a stationary jaw portion 421. In this embodiment, the clamped portion 315 is formed as a hexagonal screw nut. Since the construction of the spanner 40 has been described hereinbefore, it will be described further for the sake of brevity.

Figure 4:
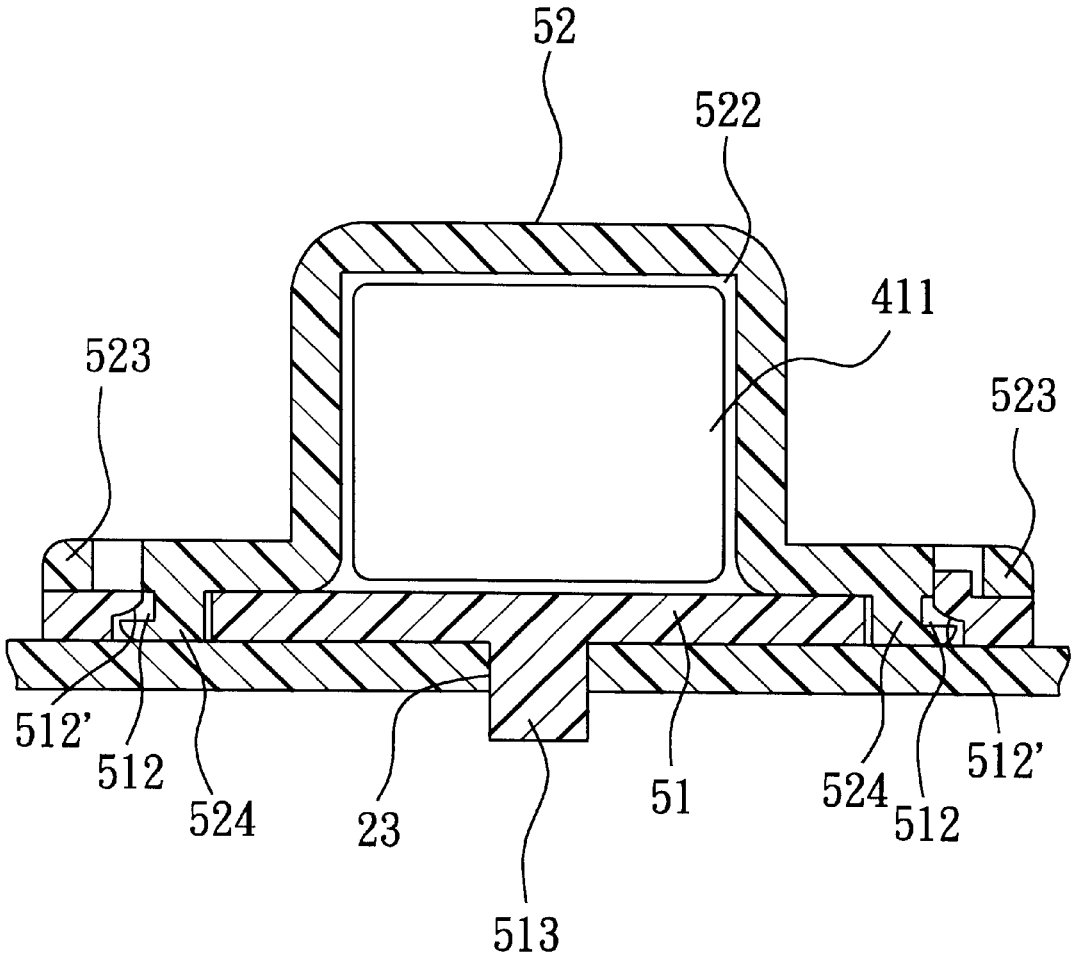
FIG. 4 is a partial cross-sectional view of the packaging and displaying device shown in FIG. 3, taken along lines IV—IV thereof.

Referring to FIGS. 2, 3 and 4, the spanner holding member 51 includes forward and rearward walls 515,516 opposite to each other in the transverse direction, and has an anchored end portion 517 which defines an anchored hole 511 that extends through the forward and rearward walls 515,516 so as to be sleeved on and to be rotated with the annular mount portion 314 of the clamped member 31 about the rotating axis, and a stabilizing end portion 518 opposite to the anchored end portion 517 in the longitudinal direction. A protrusion 513 is disposed on the rearward wall 516 at the stabilizing endportion 518, and is slidably inserted in the arcuate sliding groove 23. As such, the arcuate sliding groove 23 and the protrusion 513 serve as a key and keyway arrangement to stabilize swinging movement of the spanner 40 relative to the backing mount member 20 when the clamped member 31 rotates with the annular wheel member 33.

The securing member 50 includes an L-shaped holding rod 514 which has a first end that is secured on the forward wall 515 of the spanner holding member 51, and a second end that is spaced apart from the forward wall 515 in the transverse direction. The second end of the holding rod 514 cooperates with the forward wall 515 and the first end to confine a holding space 5141 for accommodating a handle 41 of the spanner 40 therein which is inserted in a lateral direction transverse to the transverse and second longitudinal directions.

The securing member 50 further includes two engaging slots 512 which are disposed in the forward wall 515 at the stabilizing end portion 518, which extend in the longitudinal direction, and which are spaced apart from each other in the lateral direction. As shown in FIG. 4, two limiting protrusions 512' are formed in the engaging slots 512, respectively. A U-shaped retaining plate 52 has two lateral ends 523 which are provided with two retaining blocks 524 so as to press fit in the engaging slots 512 respectively through the limiting protrusions 512'. As such, the retaining plate 52 cooperates with the forward wall 515 of the spanner holding member 51 to form an accommodation space 522 for enclosing a distal end 411 of the handle 41 of the spanner 40. Therefore, the handle 41 of the spanner 40 can be hindered from moving away from the forward wall 515 of the spanner holding member 51 to prevent theft.

Figure 5:
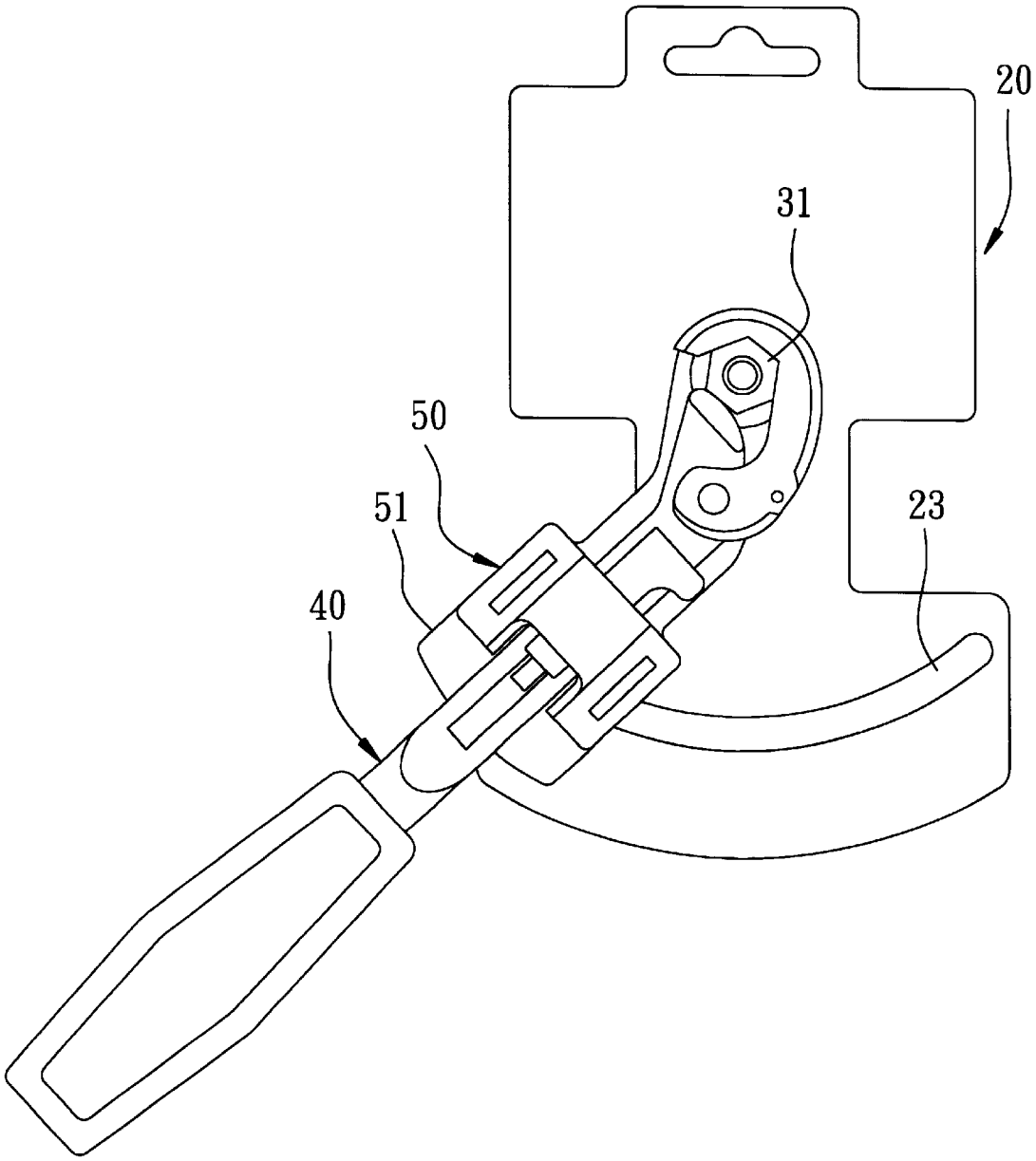
FIG. 5 is a schematic view of the preferred embodiment showing a spanner mounted thereon and rotated clockwise.
Figure 6:
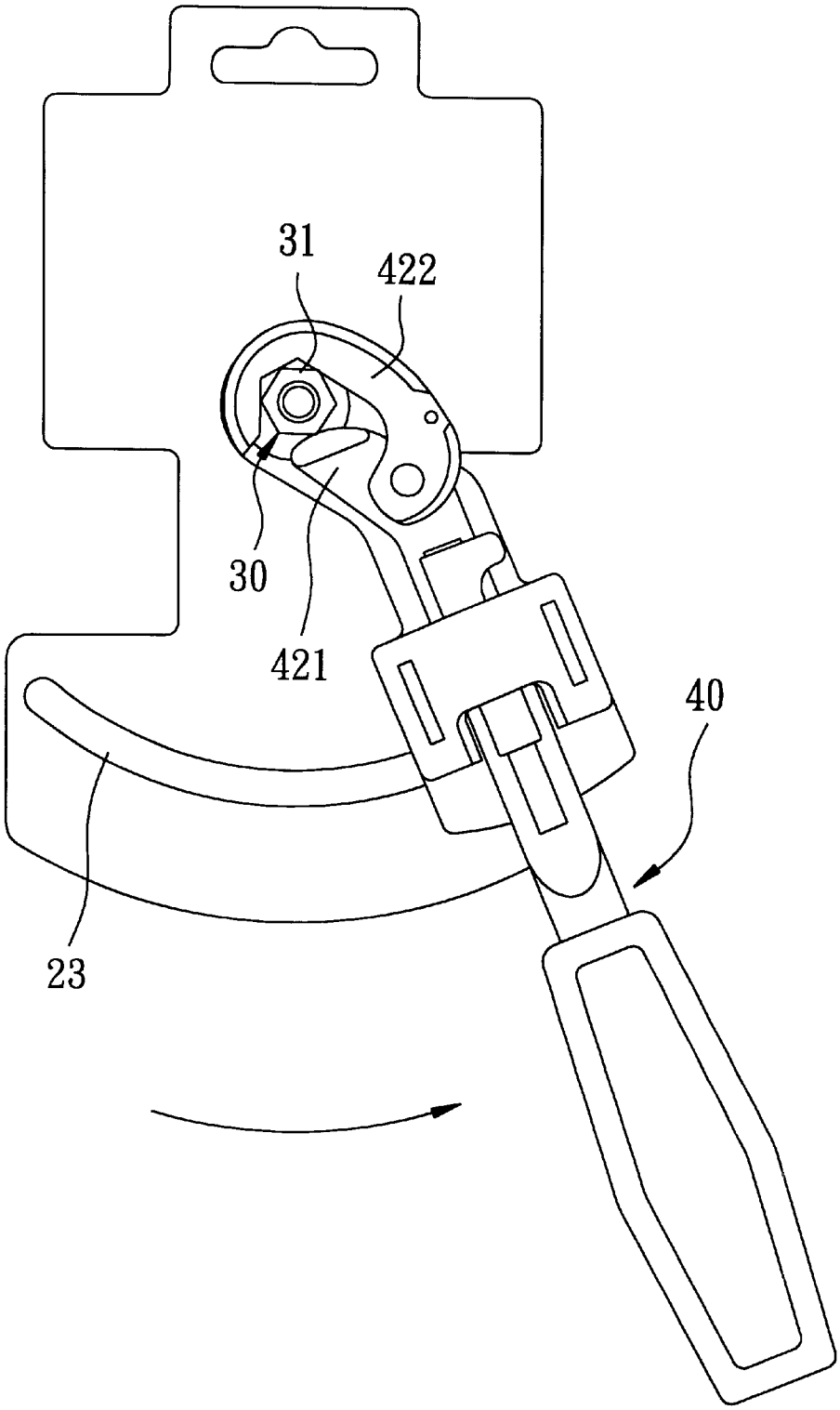
FIG. 6 is a schematic view of the preferred embodiment showing the spanner mounted thereon and rotated counterclockwise.

As illustrated, referring to FIG. 5, the spanner 40 can be rotated clockwise about the rotating axis to turn the clamped portion 315 of the clamped member 31 relative to the backing mount member 20. When the spanner 40 is rotated counterclockwise, referring to FIG. 6, the work piece member 30 is immobilized by engagement of the ratchet tooth oportion of the annular bearing wall 221 and the ratchet tooth portion 333 of the annular wheel member 33, and the movable jaw portion 422 is pivoted away from the stationary jaw portion 421. Therefore, by assembling the packaging and displaying device of this invention on a spanner 40, the vendor can practically operate the spanner 40 to enable a customer to study the same. Moreover, by virtue of the holding rod 514 and the retaining plate 52, the spanner 40 can be secured on the spanner holding member 51 to prevent theft.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A packaging and displaying device for a spanner which includes a handle with proximate and distal ends opposite to each other in a first longitudinal direction, a clamping head disposed on the proximate end and having a stationary jaw portion and a movable jaw portion that is biased to turn towards the stationary jaw portion about a pivot axis transverse to the first longitudinal direction, and a pulling rod disposed to be pulled in the first longitudinal direction to turn the movable jaw portion away from the stationary jaw portion, said packaging and displaying device comprising:

a backing mount member having front and rear walls opposite to each other in a transverse direction, said front wall including a mounting portion which has an annular bearing wall to define a through hole with a rotating axis for communicating with said rear wall, and a guiding portion opposite to said mounting portion in a second longitudinal direction;

an annular wheel member having a rim portion disposed to be rotatable relative to said annular bearing wall, and a hub portion disposed to surround the rotating axis;

a ratchet toothed member disposed between said rim portion and said annular bearing wall to permit unidirectional rotation of said annular wheel member relative to said annular bearing wall;

an anchoring member having an enlarged head portion which is disposed rearwardly of and which is in frictional contact with said rear wall of said backing mount member, and a spindle portion which has a proximate end disposed normal to said enlarged head portion and insertable into and rotatable with said hub portion, and a distal end extending from said proximate end in the transverse direction to extend forwardly of said front wall of said backing mount member;

a clamped member including a socket end disposed to engage said distal end of said spindle portion of said anchoring member by press fitting in the transverse direction, an annular mount portion disposed outwardly of said socket end to surround the rotating axis, and a clamped portion disposed opposite to said annular mount portion in the transverse direction, and adapted to be clamped by the clamping head of the spanner to coincide the rotating axis with the pivot axis when the movable jaw portion is biased to turn towards the stationary jaw portion;

a spanner holding member including forward and rearward walls opposite to each other in the transverse direction, and having an anchored end portion defining an anchored hole which extends through said forward and rearward walls so as to be sleeved on and to be rotated with said annular mount portion of said clamped member about the rotating axis, and a stabilizing end portion opposite to said anchored end portion in the second longitudinal direction;

a securing member disposed on said forward wall at said stabilizing end portion, and adapted to hinder the distal end of the handle of the spanner from moving away from said forward wall in the transverse direction; and a key and keyway arrangement disposed between said rearward wall at said stabilizing end portion of said spanner holding member and said front wall at said guiding portion of said backing mount member so as stabilize swinging movement of said spanner holding member relative to said backing mount member when said clamped member rotates with said annular wheel member.

2. The packaging and displaying device as claimed in claim 1, wherein said key and keyway arrangement includes an arcuate sliding groove formed in said front wall of said guiding portion about the rotating axis, and a protrusion disposed on said rearward wall at said stabilizing end portion and slidably inserted in said sliding groove.

3. The packaging and displaying device as claimed in claim 1, wherein said securing member includes an L-shaped holding rod having a first end secured on said forward wall, and a second end spaced apart from said forward wall in the transverse direction and cooperating with said forward wall and said first end to confine a holding space adapted for accommodating the handle of the spanner therein which is inserted in a lateral direction transverse to the transverse and second longitudinal directions.

4. The packaging and displaying device as claimed in claim 3, wherein said securing member further includes two engaging slots disposed in said forward wall at said stabilizing end portion, extending in the second longitudinal direction, and spaced apart from each other in the lateral direction, and a U-shaped retaining plate having two lateral ends of such a dimension as to press fit in said engaging slots respectively so as to cooperate with said forward wall to form an accommodation space for enclosing the distal end of the handle of the spanner.

* * * * *